United States Patent [19]

Torigai et al.

[11] Patent Number: 4,824,407

[45] Date of Patent: Apr. 25, 1989

[54] TRIMMING DEVICE FOR MARINE PROPULSION APPARATUS

[75] Inventors: Katsumi Torigai; Masanori Takahashi, both of Hamamatsu, Japan

[73] Assignee: Sanshin Kogyo Kabushiki Kaisha, Hamamatsu, Japan

[21] Appl. No.: 72,871

[22] Filed: Jul. 14, 1987

[30] Foreign Application Priority Data

Jul. 17, 1986 [JP] Japan ..... 61-166815

[51] Int. Cl.[4] ..... B63H 21/26

[52] U.S. Cl. ..... 440/1; 440/61

[58] Field of Search ..... 440/1, 61, 58–60, 440/63, 62; 318/588; 307/519; 60/432

[56] References Cited

U.S. PATENT DOCUMENTS

| | | | |
|---|---|---|---|
| 2,467,508 | 4/1949 | Trautman | 60/432 X |
| 3,008,445 | 11/1961 | Frank | 440/61 |
| 3,828,556 | 8/1974 | Nolden | 60/432 |
| 3,834,345 | 9/1974 | Hager et al. | 440/1 |
| 3,894,250 | 7/1975 | Hager et al. | 307/309 |
| 4,310,320 | 1/1982 | Pitchford | 440/61 |
| 4,318,699 | 3/1982 | Wenstad et al. | 440/1 |
| 4,413,215 | 11/1983 | Cavil et al. | 318/588 |
| 4,605,375 | 8/1986 | Ferguson | 440/1 |
| 4,718,872 | 1/1988 | Olson et al. | 440/1 |

*Primary Examiner*—Sherman D. Basinger

*Attorney, Agent, or Firm*—Ernest A. Beutler

[57] ABSTRACT

A trimming device for a marine propulsion apparatus wherein the operator may effect manual trim-up or trim-down adjustment to predetermined positions. In addition, a device is incorporated for automatically trimming down the outboard drive when the speed of the propulsion unit falls below a predetermined value.

14 Claims, 3 Drawing Sheets

TRIMMING DEVICE FOR MARINE PROPULSION APPARATUS

BACKGROUND OF THE INVENTION

This invention relates to a trimming device for a marine propulsion apparatus and more particularly to an improved control arrangement for such a trimming device in which the trimming condition of the marine propulsion unit is set automatically in response to a predetermined speed of the propulsion apparatus.

As is well known, a wide variety of marine outboard drives are supported for movement relative to the transom of an associated watercraft between a plurality of trim adjusted positions. The outboard drive may comprise an outboard motor or the outboard drive portion of an inboard/outboard arrangement. In either event, the optimum trim position of the outboard drive will be determined by a wide variety of factors and the trim adjustment permits operating at the aptimum trim angle under all of these characteristics. Frequently, a power device is provided for achieving the trim adjustment and some form of control operates the power device so as to achieve the trim adjustment. A wide variety of manual and automatic controls have been provided for this purpose.

Although automatic controls offer the advantage of reducing the likelihood of operator error in setting the trim position or in failing to change the trim position when dictated by different running conditions, the automatic controls are not fully satisfactory. The reason for this is that many of the conditions involved in the running of a watercraft vary instantaneously and unless some form of damping mechanism is employed, the automatic trim adjustment will continue to hunt for the optimum position. On the other hand, fully manual controls are not completely satisfactory because the operator may at times forget to readjust the trim position of the outboard drive even though the running conditions dictate such a change in trim position.

It is, therefore, a principle object of this invention to provide an improved trim device for a marine propulsion apparatus.

It is a further object of this invention to provide a trim apparatus for a marine outboard drive in which the main control is manual but automatic control is provided under certain running conditions.

It is a further object of this invention to provide an improved semiautomatic trim control for a marine outboard drive wherein the outboard drive is automatically trim adjusted in response to a speed condition of the propulsion device.

SUMMARY OF THE INVENTION

This invention is adapted to be embodied in a trim control apparatus for a marine outboard drive that is adapted to be supported for movement relative to the transom of an associated watercraft between a plurality of trim adjusted positions. Propulsions means are carried by the outboard drive and power means are incorporated for moving the outboard drive between the trim positions. Selectively operable control means activate the power means for operator control of the trim position of the outboard drive. In accordance with the invention, means responsive to the speed of the propulsion means are included for activating the power means to effect a change in the trim position of the outboard drive when the speed of the propulsion means reaches a predetermined value.

DETAILED DESCRIPTION OF THE PREFERRED EMBODIMENTS OF THE INVENTION

Figure 1:
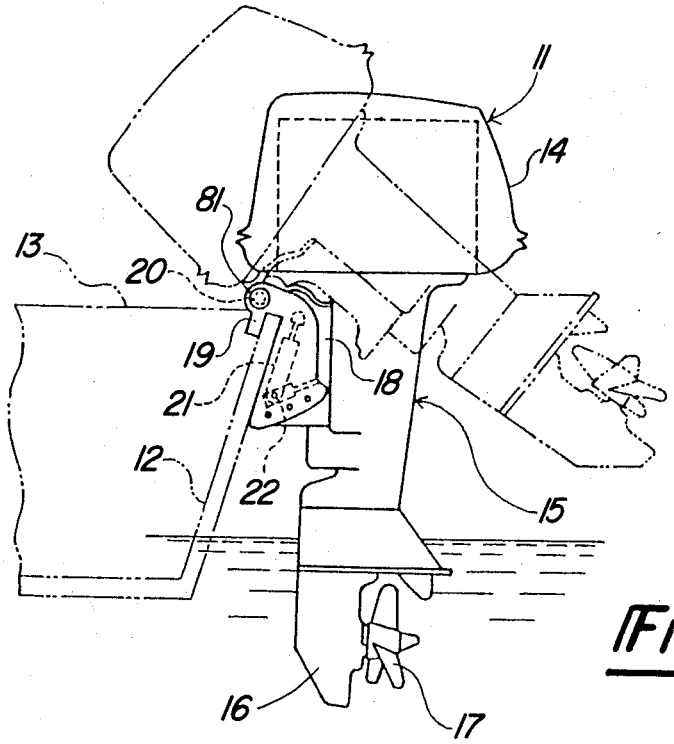
FIG. 1 is a side-elevational view of a marine propulsion apparatus constructed in accordance with a first embodiment of the invention, attached to the transom of a watercraft, shown partially and in phantom.

Referring first to FIG. 1, the general environment of the invention is illustrated wherein an outboard motor 11 is supported on a transom 12 of a watercraft 13. Although the invention is described in conjunction with an outboard motor, as has already been noted, the invention may be equally well as adaptable to the outboard drive portion of an inboard/outboard drive. The term "outboard drive" is used herein in both the specification and claims to encompass either type of arrangement.

The outboard motor 11 includes a power head 14 that contains a powering internal combustion engine of any known type and which is surrounded by a protective cowling. A drive shaft housing 15 depends from the power head 14 and contains a drive shaft (not shown) that is driven by the output shaft of the internal combustion engine. Beneath the drive shaft housing 15 there is provided a lower unit 16 in which a forward, neutral, reverse transmission (not shown) is incorporated for transferring drive from the drive shaft to a propulsion device such as a propeller 17 for powering the watercraft 12 in a known manner.

A steering shaft (not shown) is affixed to the drive shaft housing 15 in a known manner and is journaled within a swivel bracket 18. The swivel bracket 18 is, in turn, pivotally connected to a clamping bracket 19 by means of a pivot pin assembly 20 for pivotal movement of the outboard motor 11 between a plurality of trim adjusted positions and a tilted up out of the water position, as shown in phantom in FIG. 1. Although such a tilt pin arrangement is depicted as the method for achieving trim movement of the outboard motor 11, a wide variety of other supporting arrangements for achieving this purpose may be incorporated in connection with the invention.

Figure 2:
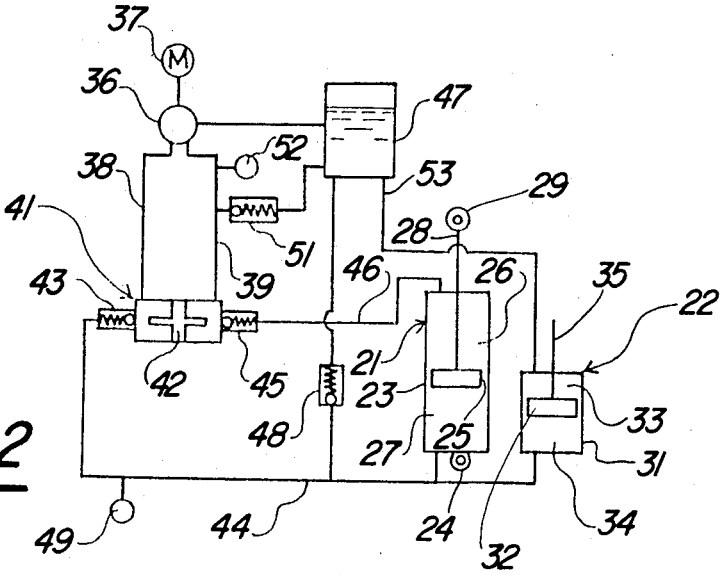
FIG. 2 is a schematic view showing the power trim adjustment of the outboard drive.

The trim and tilt position of the outboard motor 11 is controlled by a power device comprising, in the illustrated embodiment, a tilt fluid motor 21 and a trim fluid motor 22. The construction and operation of the tilt and trim fluid motors 21 and 22 will now be described by particular reference to FIG. 2.

It should be noted that the tilt fluid motor comprises a cylinder housing 23 that is pivotally connected, by means of a trunnion 24 to the clamping bracket 19. A piston 25 is slidably supported within the cylinder 23 and divides the cylinder 23 into an upper chamber 26 and a lower chamber 27. The piston 25 has affixed to it a piston rod 28 that has a trunnion 29 at its exposed outer end which is pivotally connected to the swivel bracket 28 in a known manner.

The trim fluid motor 22 is comprised of an outer housing 31 which is affixed in a suitable manner to the clamping bracket 19. A piston 32 is slidably supported within the housing 31 and divides it into an upper chamber 33 and a lower chamber 34. The piston 32 has affixed to it an extending piston rod 35 which is abuttingly engaged with the swivel bracket 18 during the range of trim adjusted positions.

The power system for activating the tilt fluid motor 21 and trim fluid motor 22 comprises a reversible fluid pump 36 that is powered by a reversible electric motor 37. The pump 36 has a pair of ports that communicate with conduits 38 and 39. The conduits 38 and 39 extend to opposite chambers of a shuttle valve assembly, indicated generally by the reference numeral 41. The shuttle valve assembly 41 is divided into these two chambers by means of a sliding piston 42. One of these chambers communicates by means of a check valve 43 with a fluid conduit 44 that extends to the lower chamber 27 of the tilt fluid motor 21 and the lower chamber 34 of the trim fluid motor 22.

A check valve 45 communicates the other of the shuttle valve chambers with a conduit 46 that extends to the upper chamber 26 of the tilt fluid motor 21.

Fluid is supplied to the system by means of a reservoir 47 that communicates with a suction or makeup port of the fluid pump 36. A tilt, trim up pressure relief valve 48 communicates the conduit 44 with the reservoir 47 and is adapted to open for tilt-up pressure relief. In addition, a tilt-up pressure sensor 49 is positioned in the line 44 for providing a pressure signal, for a reason to be described.

A tilt-down relief valve 51 communicates the pump line 39 with the reservoir 47 and is adapted to open to provide tilt-down relief under certain conditions. A tilt-down pressure sensor 52 is also provided in the line 39 to provide an indication of tilt-down pressure, for a reason also to be described.

The hydraulic system operates as follows: If the operator or system desires tilt or trim-up operation, the electrical motor 37 is energized so as to rotate the fluid pump 36 in a direction that causes the line 38 to be the pressure line and the line 39 to be the return line. Pressurization of the line 38 causes the check valve 43 to open and pressurize the line 44. Fluid pressure is then delivered to the chamber 27 of the tilt cylinder 21 and the chamber 34 of the trim cylinder 22. As a result, the pistons 25 and 32 will be urged upwardly and effect tilt-up operation of the outboard motor 11.

When the shuttle valve 41 is pressurized through the line 38, the shuttle piston 42 will shift to the right and one of its projections will unseat the check valve 45 so as to open communication of the tilt motor chamber 26 with the line 39, which as has been noted functions as the return line. Hence, fluid will be relieved from the chamber 26 back to the pump suction line 39. Also, fluid forced from the upper chamber 33 of the trim fluid motor 22 will be returned to the reservoir 47 through a return line 53.

If the motor 37 is continuously energized to the point when the piston 32 of the trim cylinder 22 reaches the end of its stroke, full trim-up operation will have been completed. However, the outboard motor 11 may be tilted up to its out of the water position as shown in the phantom line view of FIG. 1 through the continuous energization of the motor 37 in the same direction. When this occurs, all of the hydraulic fluid supplied through the line 44 will be delivered to the lower chamber 27 of the tilt cylinder 21 so as to achieve a more rapid tilt-up operation. If the motor 37 is continuously energized to the point when the piston 25 reaches the end of its stroke, the tilt-up relief valve 48 will open to provide pressure relief.

Tilt-down operation from the fully tilted up position is achieved by energizing the motor 37 so that the line 39 will be the pressure line and the line 38 will be the return line. When the line 39 is pressurized, the shuttle valve check valve 45 will open and fluid will flow into the line 46 and to the chamber 26 on the upper side of the tilt cylinder piston 25. The tilt cylinder piston 25 will then be forced downwardly. It should be noted that during this initial tilt-down operation the swivel bracket 18 will be displaced away from the trim cylinder piston rod 35.

When the line 39 is pressurized, the piston 42 of the shuttle valve 41 will be shifted to the left and the other of its projections will unseat the check valve 38. This communicates the conduit 44 with the now return line 38. Fluid expelled from the tilt cylinder chamber 27 can then be returned to the line 38 so as to function as a return line.

If the motor 37 and pump 36 are continuous operated once the swivel bracket 18 contacts the piston rod 35 of the trim cylinder 22, the piston 32 will be urged downwardly and fluid may flow into the chamber 33 from the reservoir 47 through the line 53. Fluid expelled from the lower trim cylinder chamber 34 will be returned to the pump line 38 through the shuttle valve 41 and open check valve 43.

It should be noted that trim down operation from any of the other trim positions may be achieved by the method described in the preceding paragraph.

In the event the pump 36 is continuously energized until the pistons 25 and 32 reach the bottom ends of their strokes, the tilt-down relief valve 51 will open so as to bypass fluid back to the reservoir 47 and avoid damage to the hydraulic system.

Figure 3:
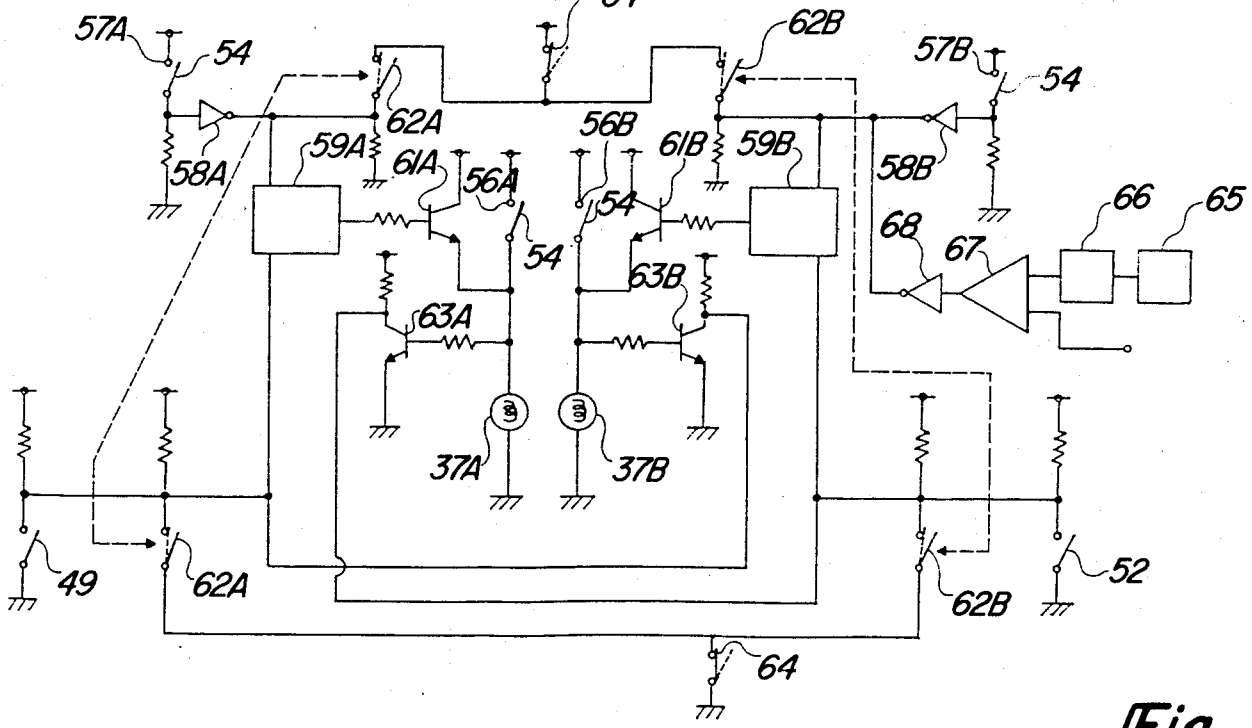
FIG. 3 is a schematic electrical circuit showing how the power trim adjustment is operated.

The control for the electric motor 37 will now be described by particular reference to FIG. 3. It should be noted that the reference characters in FIG. 3 bearing the suffix A deal with the trim-up circuit while those identified with the suffix B deal with the trim-down circuit. Basically, the control circuit shown in FIG. 3 is selectively operable by the operator so as to permit selected tilt or trim-up or down operation so long as the operator desires. Alternatively, the operator may set the device in full trim-up or trim-down mode. In addition, the device incorporates a circuit for trimming the outboard motor 11 down to the optimum trim-down position when the speed of the engine of the power head 14 falls below a predetermined value.

Figure 4:
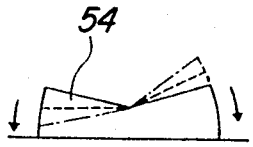
FIG. 4 is a side-elevational view of a control switch for the apparatus.
Figure 5:
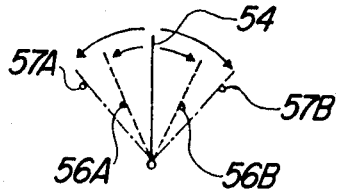
FIG. 5 is a schematic view showing the various positions of the control switch shown in FIG. 4.

Referring now to FIG. 3 and initially additionally to FIGS. 4 and 5, the manual control switch is identified generally by the reference numeral 54 and is shown in most detail in FIG. 4. FIG. 4 illustrates the control switch 54 in its normal position in solid line views. FIG. 5 shows schematically how the switch 54 functions. The switch 54 has a first contact 56A that is operative to provide trim-up operation only so long as the contact 56A is closed. In addition, there is provided a trim-up holding contact 57A which when energized will cause continuous trim-up operation. In addition, there is provided a trim-down contact 56B that is operative to provide trim-down operation only so long as it is energized and a trim-down holding contact 57B which will provide continuous trim-down operation once it has been energized.

Now referring only to FIG. 3, the up winding of the electric motor 37 is indicated at 37A and is in circuit with the contact 56A of the switch 54. The trim-down winding of the motor is indicated at 37B and is in circuit with the contact 56B of the switch 54. Closure of the switch 54 so as to complete the circuit through the contact 56A will cause the trim-up winding 37 to be energized so that the conduit 38 is pressurized by the pump 56. This trim-up operation will continue as long as the operator maintains the switch so that the contact 56A is closed. In a like manner, closure of the switch contact 56B will energize the motor winding 37B so that the pump 36 is driven in a direction so as to pressurize the line 39 and continuously cause trim-down operation as long as the contact 56B is closed.

If the operator wishes to effect full tilt-up operation of the outboard motor 11 he will move the switch 54 to the point where the terminal 57A is closed. This will energize an inverter circuit 58A that effects a low output signal to a set terminal of a flip-flop 59A so as to change its state and cause its output terminal Q to render a transistor 61A conductive so as to energize the trim-up winding 37A. Hence, full trim-up operation will then be effected due to the continuous holding of the transistor 61A in its switched on condition until the fully trimmed-up position is reached as sensed by a limit switch 62A. When the limit switch 62A is closed by full tilt-up operation, the state of the set terminal 59A will be returned to its predetermined high state and further switching on of the transistor 61A will be precluded.

In a similar manner, if full trim-down operation is desired, the operator moves the switch 54 so as to engage a holding terminal 57B. A trim-down inverter 58B is then energized so as to effect a low input to the set terminal of a trim-down flip-flop 59B so as to output a signal to a base of a trim-down transistor 61B so as to render it conductive. The trim-down winding 37B will then be continuosly energized until a trim-down limit switch 62B is closed at which time the set terminal of the flip-flop 59 will be returned to its previous high state and continuous trim-down operation will be precluded.

It should be noted that when trim-up operation is being accomplished, a reset transistor 63A will be rendered conductive and will energize the reset terminal of the flip-flop 59B so that the trim-down operation can be resumed at a desired time. In a like manner, when manual trim-down operation occurs, a reset transistor 63B will be rendered conductive and the reset terminal of the flip-flop 59A will be reset.

There is further provided a cancel switch 64 which is in circuit with the limit switches 62A and 62B. If the operator desires to achieve either tilt or trim-up or down operation even though the respective limit switches 62A and 62B have been closed, the cancel switch 64 can be opened and the limit switches will be disabled so as to permit manual operation beyond either the limited tilt or trim-up or down positions. The cancel switch 64 is a toggle type of switch so that it need not be continuously held in a position by the operator.

Furthermore, the device incorporates the pressure switches 49 and 52 in the respective tilt-up and trim-down circuit. If the pressure rises in these respective circuits, the flip-flops 59A and 59B will be reset automatically so as to disable the continued drive in the respective condition.

The circuit also includes an arrangement for achieving automatic trim-down operation of the outboard motor 11 when the speed of the propulsion unit, either the propeller 17 or the driving internal combustion engine, falls below a predetermined value so that the motor 11 will be trimmed down for the next acceleration operation. This circuit includes an output from the capacitor discharge ignition (CDI) system of the engine, indicated at 65 which provides an output signal indicative of the engine speed. This output signal is processed by a frequency to voltage converter 66 to input a reference signal to one terminal of a comparator 67. The other terminal of the comparator receives a reference voltage signal indicative of the predetermined low speed and when the signals coincide, the comparator will energize the converter 68 that will input a signal to the set terminal of the flip-flop 59 so as to effect trim-down operation. Hence, there will be automatic trimming down when the engine speed falls below a predetermined speed so that the operator need not manually trim down the outboard motor.

Figure 6:
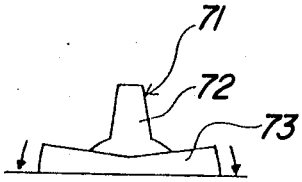
FIG. 6 is a side-elevational view of another form of control switch.
Figure 7:
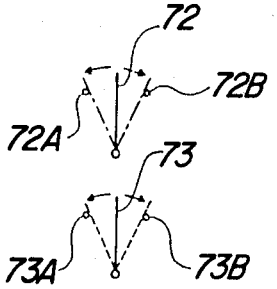
FIG. 7 is a schematic view showing the control positions of the control switch shown in FIG. 6.

FIGS. 6 and 7 show another type of control switch which can be utilized in conjunction with the invention which control switch is indicated generally by the reference numeral 71. The control switch 71 is designed with a first actuator element 72 that is movable from a neutral position to a first position wherein a manual trim-up contact 72A is closed and from that neutral position to a second position wherein a trim-down contact 72B is engaged. The contacts 72A and 72B correspond respectively to the contacts 55A and 55B of the previous embodiment and are wired into the circuit in the same way.

The switch 71 also has a second movable element 73 that is movable from a neutral position to a first position wherein a continuous trim-up contact 73A is closed and from that neutral position to a second position wherein a continuous trim-down contact 73B is closed. The contacts 73A and 73B are wired into the circuit in the same manner as the contacts 56A and 56B of the embodiment previously described.

Figure 8:
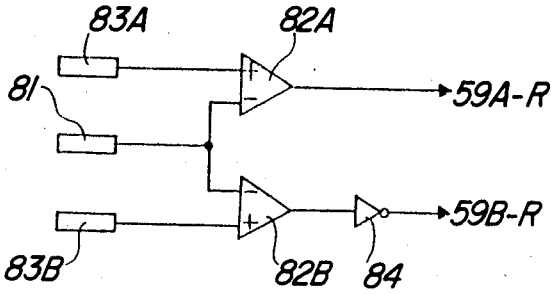
FIG. 8 is a partially schematic view of a portion of a control circuit constructed in accordance with another embodiment of the invention.

In the embodiments thus far described, the trim-up and trim-down positions were set by limit switches 62A and 62B. However, it is possible to employ an arrangement wherein the optimum trim-up and trim-down positions may be set independently by means of a system which includes an actual trim position sensor. Such an arrangement is shown in FIG. 8 wherein the trim position sensor is identified generally by the reference numeral 81. The trim position sensor 81 may, in the embodiment illustrated in FIG. 1, comprise a rotary potentiometer that is supported in juxtaposition to the pivot pin 21 and which will provide an output signal indicative of the angular position of the swivel bracket 18 about the pivot pin 21.

This output signal is transmitted to first terminals of a trim-up comparator 82A and a trim-down comparator 82B. The optimum trim-up position may be set by a variable input rim-up position sensor 83A and when the signals of the sensor 81 and input 83A coincide, the comparator 82A will output a signal to reset terminal of the flip-flop 59A so as to reset this circuit. In a similar manner, an optimum trim-down position setter 83B supplies an output signal to the other terminal of the comparator 82B. When the signals of the comparator 82B are coincident, inverter 84 will be energized so as to transmit the reset signal to the flip-flop 59B so as to reset it.

Figure 9:
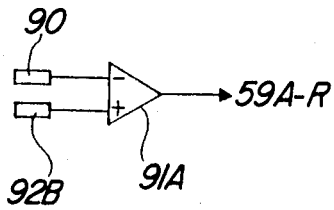
FIG. 9 is a schematic view showing an alternative arrangement for the control circuit.
Figure 9:
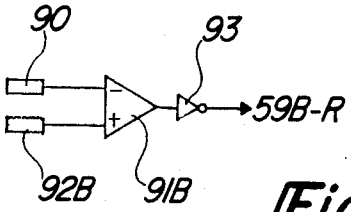

The pressure switches 49 and 52 may also be replaced by comparator circuits as shown in FIG. 9. In this view, an angular position sensor 90 inputs a signal indicative of angular position to first terminals of respective comparators 91A and 91B. This signal is compared with a maximum trim-up signal 92A or a maximum trim-down signal 92B that is existent at the other terminal of the respective comparator 91A and 92B. If the maximum trip-up condition is sensed, the comparator 91A will output a signal to the reset terminal of the trim-up flip-flop 59A so as to reset it. In a like manner, if the maximum trim-down position is sensed the comparator 91B will output a signal to an inverter 93 which will output a signal to reset the trim-down flip-flop 59B.

It should be readily apparent from the foregoing description that several embodiments of the invention have been illustrated and described and that each embodiment is effective to ensure that the operator may manually control the trim-up and trim-down condition of a marine outboard drive. In addition, the device will automatically trim down the outboard drive when the propulsion unit's speed falls below a predetermined speed so that the device will automatically be set at the right trim condition for the next acceleration phase. Although a number of embodiments of the invention have been illustrated and described, various changes and modifications may be made without departing from the spirit and scope of the invention as defined by the appended claims.

We claim:

1. In a trim control arrangement for marine outboard drive adapted to be supported for movement relative to the transom of an associated watercraft between a plurality of trim positions, propulsion means carried by said outboard drive, power means for moving said outboard drive between said trim positions, selectively operable control means for activating said power means for operator control of the trim position and said outboard drive, the improvement comprising means responsive to the speed of said propulsion means acting in parallel with said selectively operable control means and independent of the condition of said control means for activating said power means to effect a change of the trim position of said outboard drive when the speed of said propulsion means reaches a predetermined value.

2. A trim control arrangement as set forth in claim 1 wherein the means responsive to the speed of the propulsion means is effective to actuate the power means to trim-down the outboard drive when the speed of the propulsion means falls below a predetermined value.

3. A trim control arrangement as set forth in claim 1 wherein the selectively operable control means permits the operator to selectively trim-up the outboard drive or selectively trim-down the outboard drive.

4. A trim control arrangement as set forth in claim 3 wherein the selectively operable control means is selective to a first position to permit the operator to achieve either trim-up or trim-down operation only while in said first position, and a second position to achieve either trim-up or trim-down operation continuously.

5. A trim control arrangement as set forth in claim 4 further including means for discontinuing the operation of the power means when the outboard drive reaches a predetermined position.

6. A trim control arrangement as set forth in claim 5 wherein the predetermined position is sensed by a position sensor.

7. A trim control arrangement as set forth in claim 6 wherein the position sensor operates a comparator to determine the actual position and the predetermined position.

8. A trim control arrangement as set forth in claim 5 wherein the power means includes a hydraulic system and the means for discontinuing the operation is responsive to an increase in pressure in the hydraulic system.

9. In a trim control arrangement for marine outboard drive adapted to be supported for movement relative to the transom of an associated watercraft between a plurality of trim positions, propulsion means carried by said outboard drive, power means for moving said outboard drive between said trim positions, selectively operable control means for activating said power means for operator control of the trim position of said outboard drive, the improvement comprising means responsive to the speed of said propulsion means acting in parallel with said selectively operable control means for activating said power means to effect a trim down of said outboard drive when the speed of said propulsion means falls below a predetermined value.

10. In a trim control arrangement for a marine outboard drive adapted to be supported for movement relative to the transom of an associated watercraft between a plurality of trim positions, propulsion means carried by said outboard drive, power means for moving said outboard drive between said trim positions, selectively operable control means for activating said power means for operator control of the trim position of said outboard drive, the improvement comprising said selectively operable control means being selective to a first position to permit the operator to achieve either trim-up or trim-down operation only while in said first position, and a second position to achieve either trim-up or trim-down operation continuously, and means responsive to the speed of said propulsion means for activating said power means to effect a change of the trim position of said outboard drive when the speed of said propulsion means reaches a predetermined value.

11. A trim control arrangement as set forth in claim 10 further including means for discontinuing the operation of the power means when the outboard drive reaches a predetermined position.

12. A trim control arrangement as set forth in claim 11 wherein the predetermined position is sensed by a position sensor.

13. A trim control arrangement as set forth in claim 12 wherein the position sensor operates a comparator to determine the actual position and the predetermined position.

14. A trim control arrangement as set forth in claim 11 wherein the power means includes a hydraulic system and the means for discontinuing the operation is responsive to an increase in pressure in the hydraulic system.

* * * * *